US005298676A

United States Patent [19]

Sasaki et al.

[11] Patent Number: 5,298,676

[45] Date of Patent: Mar. 29, 1994

[54] TONE PARAMETER CONTROL APPARATUS

[75] Inventors: Hiroyuki Sasaki, Tokyo; Kohtaro Hanzawa, Iruma; Jun Yoshino, Tokyo; Toshiaki Kawanishi, Hiroshima; Masatoshi Watanuki, Tokyo, all of Japan

[73] Assignee: Casio Computer Co., Ltd., Tokyo, Japan

[21] Appl. No.: 4,227

[22] Filed: Jan. 12, 1993

Related U.S. Application Data

[63] Continuation of Ser. No. 850,685, Mar. 10, 1992.

[30] Foreign Application Priority Data

Mar. 22, 1991 [JP] Japan ..... 3-059162

[51] Int. Cl.[5] ..... G01H 7/00; G01H 1/04

[52] U.S. Cl. ..... 84/624; 84/629

[58] Field of Search ..... 84/624, 626, 629, 662, 84/601, 615, 653

[56] References Cited

U.S. PATENT DOCUMENTS 4,773,294 9/1988 Iizuka et al. .
4,915,007 4/1990 Wachi et al. ..... 84/629 X
5,007,323 4/1991 Usami ..... 84/601 X
5,099,741 3/1992 Komatsa et al. ..... 84/653

FOREIGN PATENT DOCUMENTS 56-40594 4/1981 Japan .
62-87990 4/1987 Japan .
3-123382 5/1991 Japan .

OTHER PUBLICATIONS

"Nikkei Electronics", pp. 122-140 (May, 14 1979).

*Primary Examiner*—William M. Shoop, Jr.
*Assistant Examiner*—Jefferey W. Donels
*Attorney, Agent, or Firm*—Frishauf, Holtz, Goodman & Woodward

[57] ABSTRACT

A plurality of groups of tone parameters different in kind required for the generation of a musical sound is stored. The tone parameters of the same kind among those tone parameters are modulated with the same sway signal generated at the same time at a desired time or at fixed intervals of time when a key concerned is depressed. The modulated parameters are either restored in the original storage region or directly delivered to a sound source. The resulting musical sound has an acoustically natural comfortable tone quality. Even if musical sounds are generated simultaneously, no sways in the respective tones of the musical sound are canceled.

21 Claims, 16 Drawing Sheets

| | PARAMETER SELECTION REGISTER 1 | PARAMETER SELECTION REGISTER 2 | NEXT TONE QUALITY NUMBER ON TABLE |
|---|---|---|---|
| (a) | 00H | 00H | 08H |
| (b) | 00H | 08H | 10H |
| (c) | 00H | 10H | 00H |
| (d) | 01H ⊕ | 10H | |
| (e) | 01H ⊕ | CLEAR<br>01H | 09H |
| | 01H | 09H | 11H |
| | 01H | 11H | 00H |
| | 02H ⊕ ⊕ | CLEAR<br>02H | |
| | ⋮ | | |
| (f) | 08H ⊕ | | |
| | | | |

FIG.10

| TONE NO. | NAME | MAX VALUE | MIN VALUE | TONE ADDRESS | FIRST BIT | NEXT TONE NO. |
|---|---|---|---|---|---|---|
| 00H | DCO1_detune | 99 | -99 | 00H | 1 | 08H |
| 01H | DCO1_LFO_depth | 99 | 0 | 01H | 1 | 09H |
| 02H | DCO1_FLU_depth | 99 | 0 | 02H | 1 | 0AH |
| 03H | DCO1_control | 99 | 0 | 03H | 1 | 0BH |
| 04H | DCO1_env_attack | 99 | 0 | 04H | 1 | 0CH |
| 05H | DCO1_env_decay | 99 | 0 | 05H | 1 | 0DH |
| 06H | DCO1_env_sustain | 99 | 0 | 06H | 1 | 0EH |
| 07H | DCO1_env_relese | 99 | 0 | 07H | 1 | 0FH |

FIRST PARAMETER GROUP

FIG.13

| TONE NO. | NAME | MAX VALUE | MIN VALUE | TONE ADDRESS | FIRST BIT | NEXT TONE NO. |
|---|---|---|---|---|---|---|
| 08H | DCO2_detune | 99 | -99 | 00H | 0 | 10H |
| 09H | DCO2_LFO_depth | 99 | 0 | 01H | 0 | 11H |
| 0AH | DCO2_FLU_depth | 99 | 0 | 02H | 0 | 12H |
| 0BH | DCO21_control | 99 | 0 | 03H | 0 | 13H |
| 0CH | DCO2_env_attack | 99 | 0 | 04H | 0 | 14H |
| 0DH | DCO2_env_decay | 99 | 0 | 05H | 0 | 15H |
| 0EH | DCO2_env_sustain | 99 | 0 | 06H | 0 | 16H |
| 0FH | DCO2_env_relese | 99 | 0 | 07H | 0 | 17H |

SECOND PARAMETER GROUP

FIG.14

| TONE NO. | NAME | MAX VALUE | MIN VALUE | TONE ADDRESS | FIRST BIT | NEXT TONE NO. |
|---|---|---|---|---|---|---|
| 10H | DCO3_detune | 99 | -99 | 00H | 0 | 00H |
| 11H | DCO3_LFO_depth | 99 | 0 | 01H | 0 | 00H |
| 12H | DCO3_FLU_depth | 99 | 0 | 02H | 0 | 00H |
| 13H | DCO3_control | 99 | 0 | 03H | 0 | 00H |
| 14H | DCO3_env_attack | 99 | 0 | 04H | 0 | 00H |
| 15H | DCO3_env_decay | 99 | 0 | 05H | 0 | 00H |
| 16H | DCO3_env_sustain | 99 | 0 | 06H | 0 | 00H |
| 17H | DCO3_env_relese | 99 | 0 | 07H | 0 | 00H |
| . | . | | | | | |
| . | . | | | | | |
| . | . | | | | | |
| FFH | end of parameter | ø | ø | | ø | 0 |

THIRD PARAMETER GROUP

FIG.15

| PARAMETER SELECTION SWITCH | PARAMETER SELECTION REG. VALUE |
|---|---|
| S0 | 00H |
| S1 | 08H |
| S2 | 10H |
| S3 | 18H |
| S4 | 20H |
| S5 | 28H |

FIG.16

| ENTRY DIAL | DIAL REG. VALUE |
|---|---|
| E0 | 00H |
| E1 | 01H |
| E2 | 02H |
| E3 | 03H |
| E4 | 04H |
| E5 | 05H |
| E6 | 06H |
| E7 | 07H |

FIG.17

TONE PARAMETER CONTROL APPARATUS

This application is a continuation of application Ser. No. 07/850,685, filed Mar. 10, 1992.

BACKGROUND OF THE INVENTION

1. Field of the Invention

The present invention relates to tone parameter control apparatus used in electronic musical instruments or the like which control tone parameters used to generate a musical sound.

2. Description of the Related Art

Conventionally, it is well known that the amplitude and frequency of a musical sound generated from an electronic instrument or the like are changed in response to the output of a low frequency oscillator (LFO) or an envelope oscillator to apply various musical effects to the generated musical sound.

However, the output from such LFO or envelope oscillator is very monotonous, so that the effects produced by the use of such outputs are artificial and unnatural.

In view of such situation, it has been considered to modulate tone parameters required for generation of a musical sound with a more irregular natural signal, for example, of noise having a power spectrum of a magnitude of 1/f inversely proportional to a frequency of f, or a 1/f sway (or fluctuation) signal and not a signal from such LFO or envelope oscillator.

By the use of this system, addition of sway (or fluctuation) of a natural tone which is not provided by the conventional musical sound generator is realized.

However, easy addition of this sway (or fluctuation) may cause the following problems. Throughout the following description and claims, the term sway signal is used, which is synonymous with the term fluctuation signal.

If a 1/f sway signal is separately applied to tone parameters without considering the relationship between the tone parameters, for example, when a plurality of tones are generated in unison, a natural sway effect of a tone based on the 1/f sway signal would undesirably be canceled greatly and reduced.

If 1/f sway signals are added to several tone parameters of the same kind, for example, on the modulation depth of the LFO applied separately to three different tone ranges of an electronic instrument and if a musical sound in one tone range and then another musical sound in another range are generated sequentially, the sway levels of the tones may undesirably differ from each other and the tone would sound unnatural.

SUMMARY OF THE INVENTION

It is an object of the present invention to provide a tone parameter control apparatus which changes the values of tone parameters of the same kind in correspondence to the same sway signal when a plurality of tone musical sounds related to each other are generated.

According to one aspect of the present invention, there is provided a tone parameter control apparatus comprising:

tone parameter storing means storing a plurality of groups of tone parameters different in kind and used for generation of a musical sound;

sway signal outputting means for outputting a sway signal;

tone parameter readout means for sequentially reading out tone parameters of the same kind among tone parameters different in kind and of the respective groups stored in said tone parameter storing means;

parameter modulating means for modulating the respective parameters of the same kind read out by said tone parameter readout means with the same sway signal generated at the same time by said sway signal generating means and re-storing the modulated tone parameters in said tone parameter storing means.

By this arrangement, the parameters of the same kind are changed at all times in correspondence to the same sway. The musical sound generated by these parameters does not cancel that sway when they occur simultaneously. When musical sounds are generated successively and not simultaneously, they do not differ greatly from the previously generated ones to thereby provide a natural sway.

It is another object of the present invention to provide an electronic musical instrument in which when a plurality of musical sounds having different timbre related to each other is generated the values of tone parameters of the same kind are changed in correspondence to the same swaying signal and a musical sound is generated on the basis of the changed tone parameters.

According to one aspect of the present invention, there is provided an electronic musical instrument comprising:

pitch designating means for designating a pitch of a musical sound;

tone parameter storing means for storing a plurality of groups of tone parameters different in kind and used for generation of a musical sound;

sway signal outputting means for outputting a sway signal;

tone parameter readout means for sequentially reading out tone parameters of the same kind among tone parameters different in kind and of the respective groups stored in said tone parameter storing means;

parameter modulating means for modulating the respective parameters of the same kind read out by said tone parameter readout means with the same sway signal generated at the same time by said sway signal generating means and for re-storing the modulated tone parameters in said storing means; and musical sound generating means for generating a musical sound on the basis of the pitch data designated by said pitch designating means and tone parameters of the respective groups stored in said tone parameter storing means.

According to this arrangement, musical sounds having tone parameters of the same kind become tones having the same sway, so that when musical sounds are generated simultaneously, their sways are not canceled to thereby provide a natural comfortable musical effect.

It is a further object of the present invention to provide an electronic musical instrument which, when a plurality of musical sounds having different timbres related to each other are generated, adds the same sway effect to musical sounds generated without changing the values of the tone parameters of the same kinds stored.

According to one aspect of the present invention, there is provided an electronic musical instrument comprising:

pitch designating means for designating a pitch of a musical sound;

tone parameter storing means for storing a plurality of groups of tone parameters different in kind and used for generation of a musical sound;

sway signal outputting means for outputting a sway signal;

tone parameter readout means for sequentially reading out tone parameters of the same kind among tone parameters different in kind and of the respective groups stored in said tone parameter storing means in response to the operation of said pitch designating means;

parameter modulating means for modulating the respective parameters of the same kind read out by said tone parameter readout means with the same sway signal generated at the same time by said sway signal generating means; and musical sound generating means for generating a musical sound on the basis of the pitch data designated by said pitch designating means and tone parameters modulated by said parameter modulating means.

According to this arrangement, when a plurality of musical sounds having different timbres related to each other are generated, the same sway effect is added to the tones of the musical sounds generated. Further, since the values of the tone parameters stored at that time are not changed, the values set initially are not greatly changed by the sway.

It is another object of the present invention to provide a tone parameter control apparatus which, when a plurality of musical sounds having different timbre related to each other are generated, produces natural sways of the tone qualities.

According to one aspect of the present invention, there is provided a tone parameter control apparatus comprising:

tone parameter storing means for storing a plurality of groups of tone parameters different in kind and used for generation of a musical sound;

sway signal outputting means for outputting a sway signal; and parameter modulating means for modulating parameters of the same kind among the tone parameters different in kind and of the respective groups stored in said tone parameter storing means with the same sway signal generated at the same time by said sway signal generating means.

According to this arrangement, when a plurality of tone parameters related to each other are controlled, the tone parameters of the same kind can be modulated with the same sway signal.

Therefore, for example, when the present invention is applied to electronic musical instruments, where effects produced, for example, by an LFO are applied to lower, medium and upper tone ranges of a tone range of a musical sound generated, or when effects are added to respective musical sound signals generated simultaneously by a single keying operation, sways related highly to each other are provided. As a result, a natural comfortable musical effect is produced from an acoustic standpoint.

For example, when a plurality of musical sounds having different timbre generated in unison, the same sway is applied to each of the tone parameters, so that the sway effects are not be canceled to thereby provide tone having natural sways.

BRIEF DESCRIPTION OF THE DRAWINGS

These and other objects or features of the present invention will easily be understood by those skilled in the art from the following description of preferred embodiments of the present invention, when taken in conjunction with the accompanying drawings.

In drawings;

FIG. 10 illustrates the designation of a tone parameter by a parameter selective register.

FIG. 11 is a flowchart indicative of the operation of the apparatus when a changeover switch is turned on.

FIG. 13 illustrates one example of a tone parameter table (part 1).

FIG. 14 illustrates one example of the tone parameter table (part 2).

FIG. 15 illustrates one example of the tone parameter table (part 3).

FIG. 16 shows the correspondence between parameter selective switches and parameter register values.

FIG. 17 shows the correspondence between entry dials and dial registers.

DETAILED DESCRIPTION OF THE PREFERRED EMBODIMENT

An embodiment of the present invention will be described hereinafter with reference to the accompanying drawings.

OVERALL STRUCTURE OF AN EMBODIMENT

Figure 1:
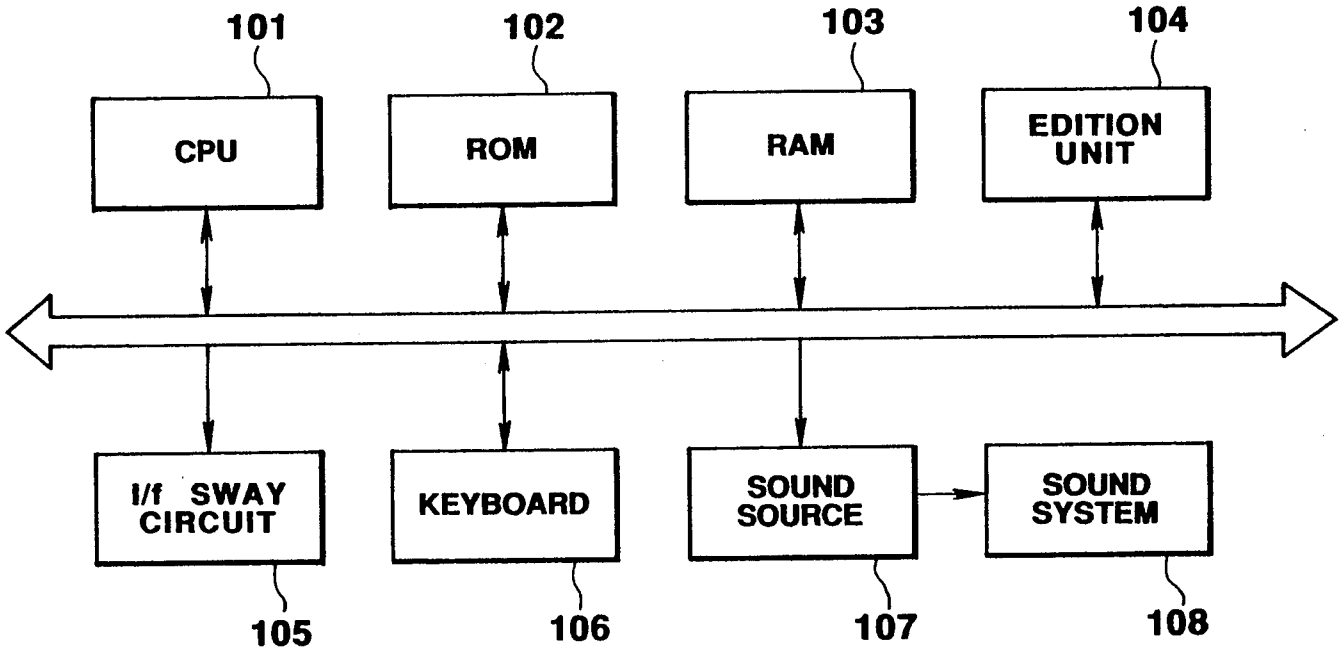
FIG. 1 is an overall schematic of one embodiment of the present invention.

FIG. 1 is an overall schematic of one embodiment of the present invention.

In FIG. 1, a CPU (Central Processing Unit) 101 controls the overall system in accordance with a program stored beforehand in a ROM (Read Only Memory) 102. CPU 101 scans a keyboard unit 106 and an edition unit 104 at fixed periods to fetch playing data required for playing such as pitch data and note length data obtained from a depressed key 106*c* (see FIG. 3) of the keyboard unit 106 or tone data designated by a tone designation switch 106*a* (see FIG. 3) and data on the operated state of edition unit 104.

A 1/f sway circuit 105 generates a 1/f sway output, which is added to the numerical value of each of tone parameters set beforehand in entry dial 203 of edition unit 104 at depression by key 106*c* for playing purposes or at the operation of changeover switch 106*b* or at fixed periods determined by timer interruption to thereby add a "1/f sway" characteristic to each of the tone parameters, as will be described in more detail.

Figure 2:
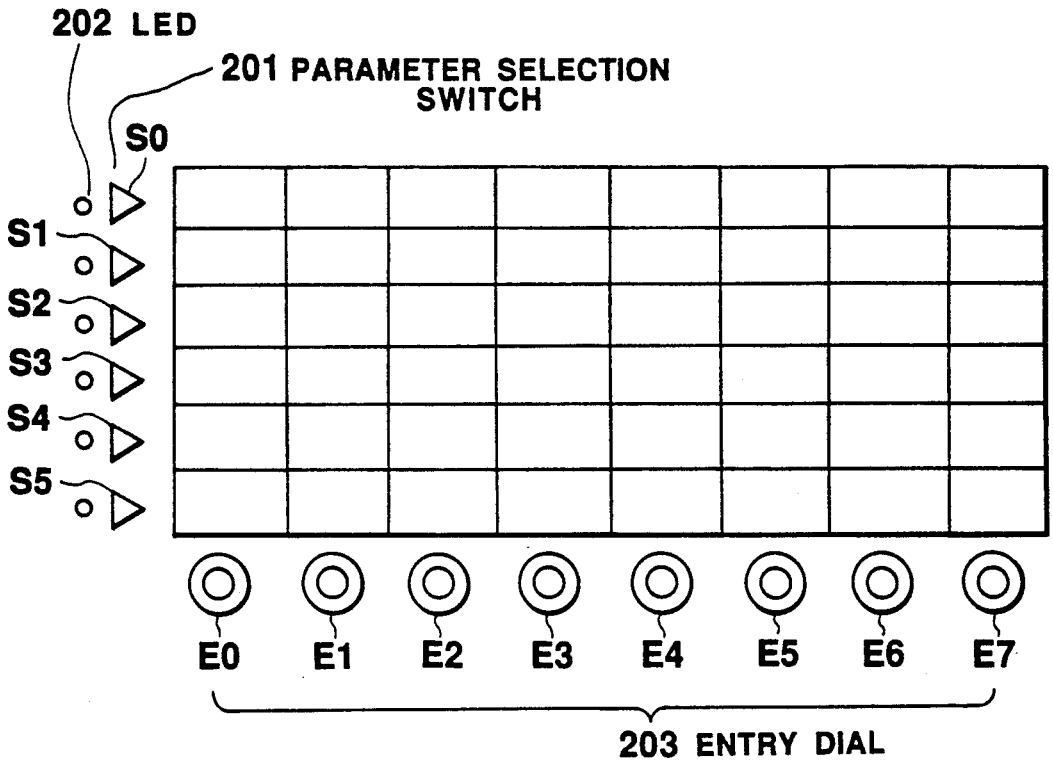
FIG. 2 shows the appearance of an edition unit.

FIG. 2 shows the appearance of edition operating unit 104 of FIG. 1. This unit includes 6 parameter selective switches 201 (S0, S1, . . . , S5) and 8 entry dials 203 (E0, E1, . . . , E7). Parameter selective switches 201 (S0, S1, . . . , S5) correspond to 6 parameter groups to be described later in more detail while entry dials 203 (E0, E1, . . . , E7) correspond to 8 kinds of tone parameters to be described later in more detail.

Tone parameters set through edition unit 104 are the ones which control the pitch, sound volume, filter cut-off frequency, and LFO of each musical sound generated by a sound source 107.

A player can designate any one of a maximum of 6 parameter groups by operating a corresponding one of 6 parameter selective switches 201 (S0, S1, . . . , S5) and also designate 8 kinds of tone parameters using entry dials 203 (E0, E1, . . . , E7) for each of the groups. In this case, if the player splits keyboard unit 6 into a plurality of tone ranges such that a musical sound having a tone varying from one tone range to another tone range is generated, one parameter group is allocated to each tone range and 8 kinds of tone parameters are set independently for each tone range. Alternatively, if the player generates a plurality of musical sound signals having differnt timbre simultaneously by depressing a single key of keyboard unit 106, one parameter group is allocated to each of the musical sound signals and thus, 8 kinds of tone parameters are set for each of the musical sound signals.

CPU 101 adds the output of 1/f sway circuit 105 to the numerical value of each of the tone parameters set as mentioned above to thereby give a "1/f sway" characteristic to that tone parameter. In this case, a great feature of this embodiment is that CPU 101 adds the same "1/f sway" characteristic to the tone parameters of the same kind among the 8 kinds of tone parameters of the respective parameter groups.

CPU 101 delivers to sound source 107 playing data obtained by playing through keyboard unit 106 and the respective tone parameters changed in accordance with the output of the 1/f sway circuit 105. Sound source 107 generates musical sound waveform data in accordance with, for example, a PCM sound source system on the basis of these data. In this case, sound source 107 generates musical sound waveform data using the respective sound tone parameters to which CPU 101 has given the "1/f sway" characteristic and using the 8 kinds of tone parameters of a different parameter group for a different tone range, as mentioned above.

In this way, the musical sound waveform data generated by sound source 107 is broadcasted from a sound system 108.

The actual values of the 8 kinds of tone parameters of each of the 6 parameter groups are stored in the tone parameter region on a RAM (Random Access Memory) 103. Tone numbers are allocated to the respective tone parameters to become address data used to access the respective tone parameters on RAM 103.

A tone parameter table indicative of attribute data to control the 8 kinds of tone parameters of each of the 6 parameter groups is stored in ROM 102. The attribute data contains tone numbers which are address data corresponding to the respective tone parameter values on RAM 103, tone parameter names, the maximum and minimum values of the parameter values permitted for the respective tone parameters, tone addresses indicative of the respective kinds of the tone parameters and the first bits and the next tone numbers, to be described later in more detail, in this order. FIGS. 13-15 show an illustrative tone parameter table in which 3 parameter groups are set in the corresponding regions of tone numbers 00H-07H, 08H-0FH, 10H-17H with attribute data on 8 kinds of tone parameters DCO_detune-DCO_env_release for each parallel group.

PRINCIPLES OF "1/f SWAY"

A "1/f sway" will be described before 1/f sway circuit 105 is described.

For example, quantitative examination of the period of heartbeats from an electrocardiogram where the heartbeats are recorded in a mentally and physically quiet state will show that each of the periods of heartbeats sways slightly. The power spectrum of this sway in the period of heartbeats is substantially inversely proportional to frequency of f. Such spectrum is usually called "1/f spectrum" and the original sway is called "1/f sway". A human body has a 1/f sway in each of various portions thereof in addition to heartbeats. It is known that a human being becomes comfortable when he hears a sway having a 1/f spectrum or receives a stimulus of such kind, he will feel comfortable. In the case of music, a quantity which characterizes a played sound is the frequency and magnitude of the sound. The present embodiment is characterized by addition of the 1/f sway to the tone parameters in order to generate a natural comfortable tone.

STRUCTURE OF 1/f SWAY CIRCUIT 105

Figure 4:
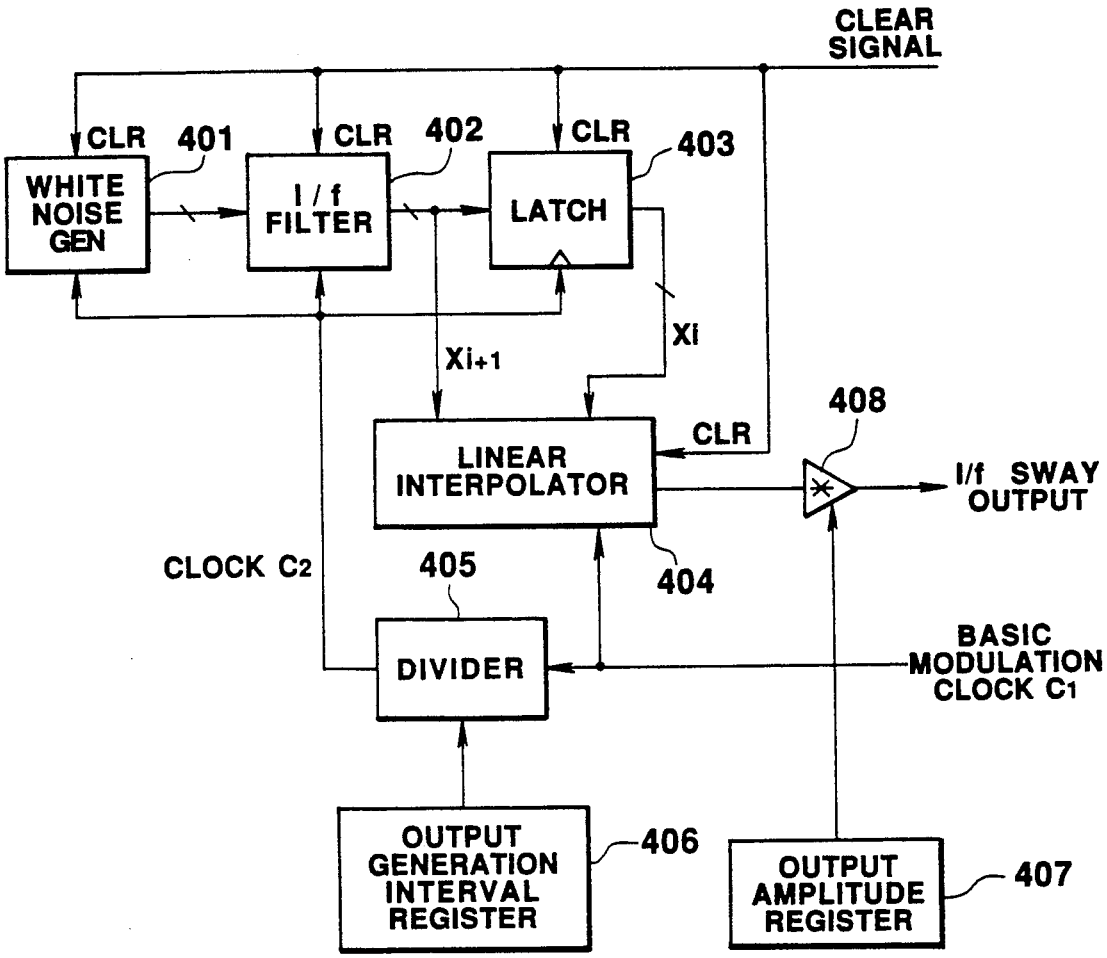
FIG. 4 is a block diagram indicative of an overall structure of a 1/f sway circuit.

FIG. 4 is a block diagram indicative of an overall structure of 1/f sway circuit 105 to generate a 1/f sway described above.

In FIG. 4, white noise generated by a white noise generator 401 is converted by a 1/f filter 402 (to be described later in more detail) to 1/f sway noise having a power spectrum of a magnitude of 1/f (inversely proportional to frequency of f). Clock $C_2$ applied to white noise generator 401 and 1/f filter 402 is obtained by dividing in a frequency divider 405 a basic modulation clock $C_1$ having a period, for example, of 10 ms In this case, if divider 405 is a 1/16 divider, the period of clock $C_2$ is 160 ms, for example.

By using such clock $C_2$ having such period, the output from 1/f filter 402 changes intermittently in amplitude at the period f clock $C_2$ (several times per second). Therefore, if the tone parameters are modulated with such signal as it is, the tone would be changed rapidly and discontinuously to an unnatural one. Therefore, as will be described in more detail, a change in the output of 1/f filter 402 is linearly interpolated for each period of clock $C_2$ to thereby smooth changes in the amplitude of the 1/f sway noise.

While such 1/f sway noise is generated at periods of clock $C_2$, the period of generation of the 1/f sway output is changed naturally if the frequency of clock $C_2$ is changed to thereby give a change in the tone parameters. Therefore, this is preferable. To this end, the user can beforehand set in an output generation interval register 406 an interval control parameter to control the interval of the 1/f sway output to thereby change the division coefficient of divider 405. In this case, the division coefficient is set to $1/2^n$ where n is an integer.

The user can beforehand set in output amplitude register 407 an amplitude control parameter to control the modulation depth of the tone parameter by the 1/f sway output. By multiplying the 1/f sway output by the register value in multiplier 408, the amplitude of the 1/f sway output is controlled.

Figure 5:
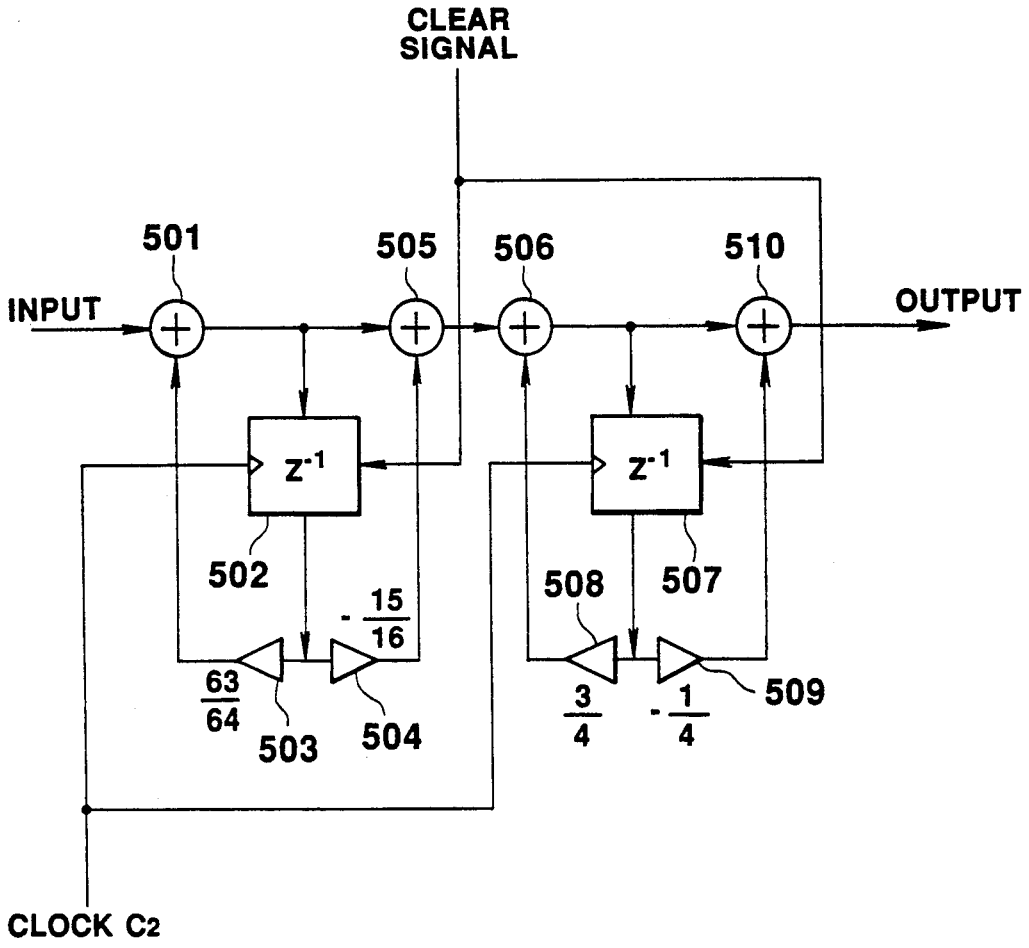
FIG. 5 is a block diagram indicative of the structure of a 1/f filter.

FIG. 5 is a block diagram indicative of the structure of 1/f filter 402 of FIG. 4. The 1/f filter of FIG. 5 is a secondary IIR(Infinite Impulse Response) type filter where $Z^{-1}$ in each of blocks 502, 507 denotes a delay element which generates a delay equal to one period of a read clock. Multipliers 503, 504, 508, 509 have multiplication factors of 63/64, −15/16, 3/4, −1/4, respectively. Further, adders as 501, 505, 506 and 510 are used to compose a digital filter of FIG. 5 to thereby provide a 1/f type frequency response inversely proportional to the frequency of f.

In FIG. 4, the output from 1/f filter 402 generated in accordance with clock $C_2$ is latched in latch 403. Output $X_i$ from 1/f filter 402 preceding by one timing from latch 403 and output $X_{i+1}$ from 1/f filter 402 at the current timing are input to linear interpolator 404.

Figure 6:
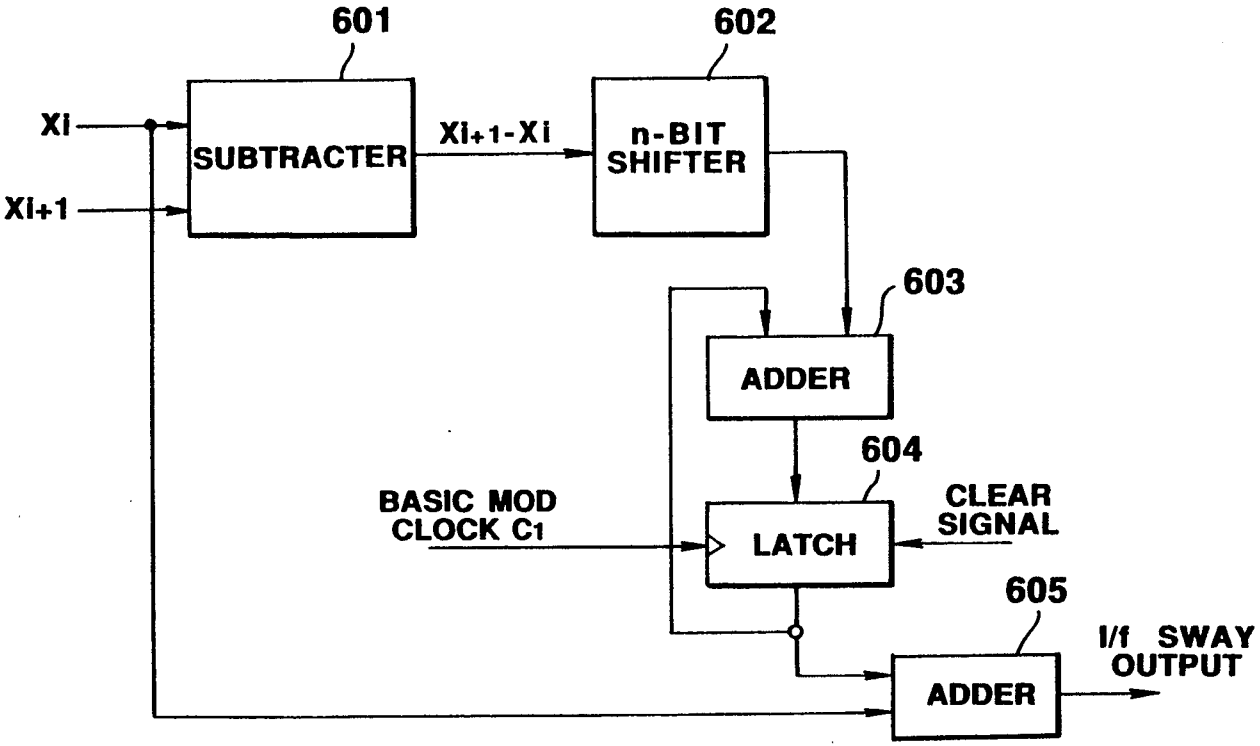
FIG. 6 is a block diagram indicative of the structure of a linear interpolator.

FIG. 6 is block diagram indicative of the structure of linear interpolator 404 of FIG. 4. In FIG. 6, subtracter 601 calculates the differential value $(X_{i+1} - X_i)$ between outputs $X_i$ and $X_{i+1}$ and the differential value is then shifted by n bits, for example by 4 bits, in n-bit shifter 602. This quantity of shift n corresponds to the division coefficient of $1/2^n$ in frequency divider 405 of FIG. 4.

Figure 7:
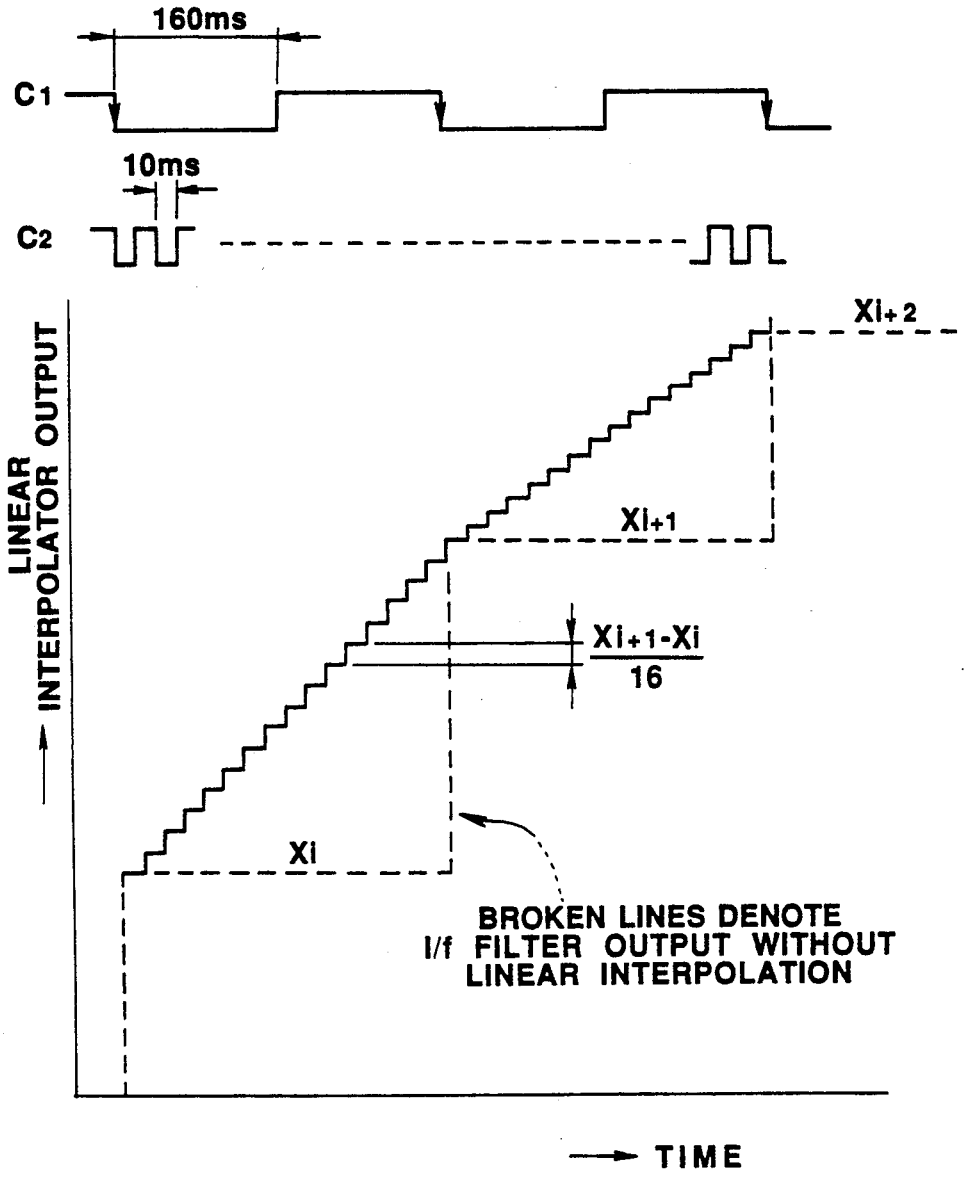
FIG. 7 illustrates the operation of the linear interpolator.

Thus, the value, for example, of 1/16 of the differential value is obtained, which is input to latch 604 through adder 603 each time a basic modulation clock $C_1$ is received. The latch output is again applied to adder 603 and then accumulated sequentially to 1/16 of the differential value, as shown in FIG. 7.

During such processing, the output from latch 604 is added to input $X_i$ to subtracter 601 in adder 605, which then outputs a 1/f sway output.

As described above, even if the amplitudes $X_i$ and $X_{i+1}$ of the successive timing signals of the 1/f sway noise generated at the periods (for example, of 160 ms) of clock $C_2$ differ greatly, those amplitude values between $X_i$ and $X_{i+1}$ are linearly interpolated 16 times at each of basic modulation clocks $C_1$ having a period, for example, of 10 ms. Thus, the amplitude of the 1/f sway noise is changed gradually in units of $(X_{i+1} - X) \times (1/16)$ (see FIG. 7).

EDITION OF TONE PARAMETERS

Edition of the tone parameters in the present apparatus will be described with reference to the operation flowchart of FIG. 8. This flowchart is a subroutine program executed repeatedly with time as a part of the main program executed by CPU 101 of FIG. 1.

First, at step S801 it is determined whether the player has depressed parameter selective switch 201. If the determination is YES, the value of the parameter selective register in CPU 101 is changed in correspondence to the switched-on selective switch 201, as shown in FIG. 16. For example, if S1 of parameter selective switches 201 is depressed, the value of the parameter selective register is changed to 08H ("H" represents a hexadecimal number) (step S802). If no parameter selective switch 201 has been depressed, the determination at step S801 is NO and no parameter edition is performed.

At step S803 the values of the dial register (see FIG. 17) which store register values (00H–07H) corresponding to the respective entry dials 203 (E0–E7 of FIG. 2) are reset to 00H.

Thereafter, the dial numerical value of entry dial 203 corresponding to the value set in the dial register (in this case, the E0 dial because the register value is 00H) is read (step S804).

In this case, the entry dial 203 turns around the value of 0 in − and + directions and the resulting dial numerical value may not be used as it is. No negative numerical values are used, for example, in the DC01 FLU_depth which is the tone number of FIG. 13, (the modulation depth in application of flanger) DC01_control (control quantities for vender, sustain pedal and modulation wheel) or DC01_env_attac (the magnitude of the envelope at attack). Consequently, the dial numerical value is restricted in the following manner.

The maximum and minimum values of a tone quality number corresponding to the sum of the parameter selective register value and dial register value are read from the tone parameter table (step S805). For example, if S1 of parameter selective switches 201 is depressed, a maximum value of 99 and a minimum value of 0 (see FIG. 14) of the tone number 0DH (the tone parameter name "DC02_env_decay") of the sum of parameter selective register value 08H and dial register value 05H are read out for E5 of entry dial 203 for E5 of entry dial 203. The dial numerical value read out at step S804 is restricted by the maximum and minimum values read out at step S805 (step S806). In the case of tone parameter DC02_env_decay, the minimum value is 0, so that if the dial numerical value is negative, all the numerical values are changed to 0.

The dial numerical value restricted as mentioned above is written into a tone parameter region on RAM 103 corresponding to a tone number on the tone parameter table corresponding to the sum of the parameter selective register value and dial register value obtained at step S805 (step S807). In this way, the parameter value is fixed.

Thereafter, the current value of the dial register is incremented by one and the next entry dial 203 is to be handled now (step S808).

In this way, until the dial register value becomes 7 and the processing for the E7 entry dial 203 (see FIG. 2) is terminated, the loop processing at steps S804–S809 continues. When the determination at step S809 becomes YES, parameter edition for one of parameter selective switches 201 is terminated.

Figure 8:
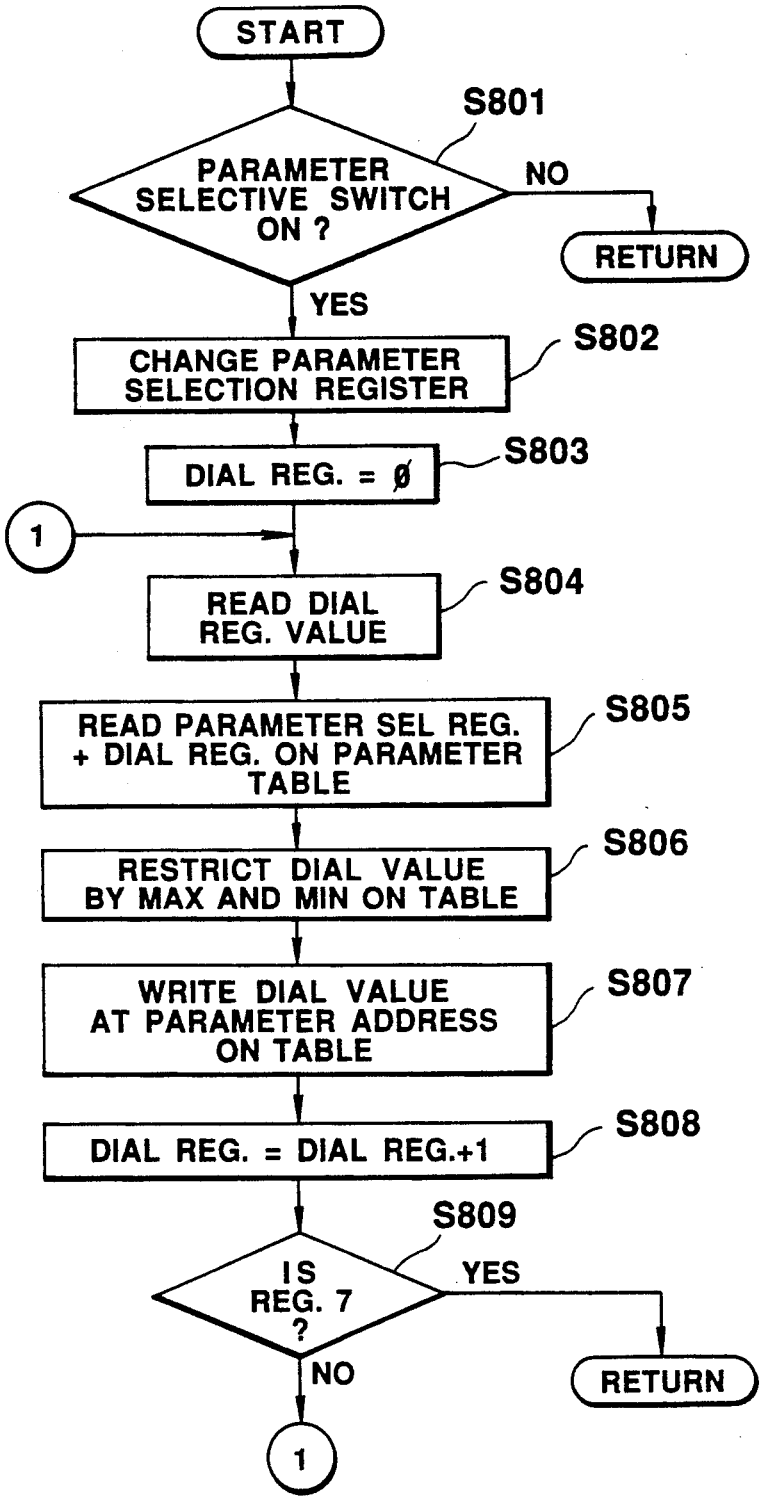
FIG. 8 is an operation flowchart indicative of edition of tone parameters of the present apparatus.

As described above, when the player sequentially operates the maximum of 6 parameter selective switches 201 (S0–S5) and the maximum of 8-entry dials 203 (E0–E7), any one of parameter selective switches 201 which has been switched on is detected at each of the timings at which CPU 101 repeatedly executes a program instruction corresponding to step S801 of the operation flowchart of FIG. 8 as a part of the main program. Thus, the tone parameters corresponding to the parameter selective switches 201 switched on at step S802–S809 are edited and the results are written into the tone parameter region of RAM 103.

Addition of the "1/f sway" characteristic to tone parameters by adding the output of 1/f sway circuit 105 to the respective tone parameter numerical values set as mentioned above will be described in order.

Figure 3:
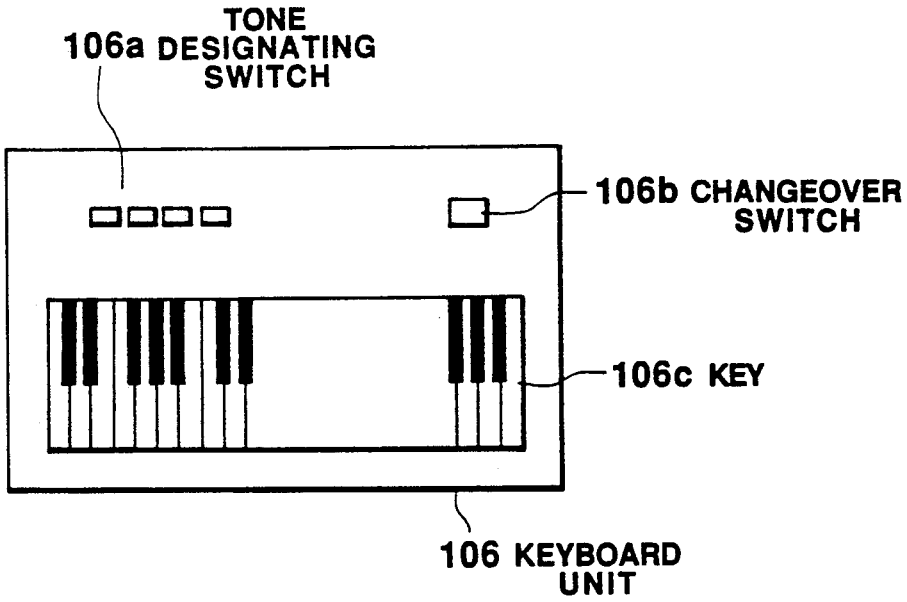
FIG. 3 shows the appearance of a keyboard unit.

Such addition of the "1/f sway" characteristic is executed when a key of keyboard 106 is depressed, when changeover switch **106*b* of FIG. 3** is depressed and at fixed intervals of time due to timer interruption. Operations performed at these respective timings will be described hereinafter.

OPERATION OF CPU PERFORMED WHEN A KEY IS DEPRESSED

The operation of CPU 101 performed when a key is depressed will first be described.

Assume that CPU 101 has two parameter selective registers 1 and 2. One of the registers is the same as the above parameter selective register. Set in parameter selective register 2 is a tone number which is a address used to directly access the tone parameter table on ROM 102. A relative address value (hereinafter referred to as a tone address) in each parameter group is set in parameter selective register 1 to thereby designate the kind of a tone parameter of the 8 kinds of tone parameters to be handled at present.

First, the basic operation of CPU 101 to control the tone parameters will be outlined. The following description handles an example in which the player has set a first, a second and a third parameter groups.

First, the address pointer which is the contents of parameter selective register 2 designates a tone number 00H (see FIG. 13) of the first parameter group of the tone parameter table on ROM 102. Under such conditions, a 1/f sway output is read out of 1/f sway circuit 105 and the actual numerical value (parameter value) of the tone parameter corresponding to tone number 00H is read out of RAM 103, and both values are added. The result of this addition is delivered to sound source 107. By these operations, a "1/f sway" effect is added to tone parameter DC01_detune which the player set beforehand by the above parameter edition.

After one tone parameter is delivered to sound source 107 in this way, the address pointer designates tone number 08H (see FIG. 14) of the second parameter group of the tone parameter table. Under such conditions, the same output value from 1/f sway circuit 105 used for the previous tone number 00H is added to the parameter value of the tone parameter DC02_detune and the result is transferred to sound source 107. Thus, the same "1/f sway" characteristic is added although the manner in which the detune is added differs because the parameter value differs.

Subsequently, the address pointer shifts to tone number 10H (FIG. 15) of the third parameter group to thereby perform the processing for tone parameter DC03_detune in the same manner as mentioned above and as a result the parameter value to which the same "1/f sway" characteristic is added is transferred to sound source 107.

Thereafter, the address pointer shifts to tone number 01H of the first parameter group. Under such conditions, a new 1/f sway output is read out of 1/f sway circuit 105, a parameter value corresponding to tone number 01H is read out of RAM 103, and both are added. The result of this addition is delivered to sound source 107. Thus, a "1/f sway" effect having a new characteristic is added to the DC01_LFO_depth which is a tone parameter of a kind different from the DC01detune and set beforehand the player, using the above mentioned parameter edition.

Thereafter, the address pointer shifts sequentially to the respective tone numbers corresponding to tone parameters DC02_LFO_depth and DC03_LFO_depth of the same kind of the second and third parameter groups and the "1/f sway" characteristic is added to those parameter values on the basis of the same output value from 1/f sway circuit 105 and the resulting signals are sequentially transferred to sound source 107.

Similarly, processing for a total of 8 kinds of tone parameters continues until the "1/f sway" characteristic is added on the basis of the same output value from 1/f sway circuit 105 to those of the same kind of the 8 tone parameters of the three respective parameter groups and having the same relative position in the three respective parameter groups.

Figure 9:
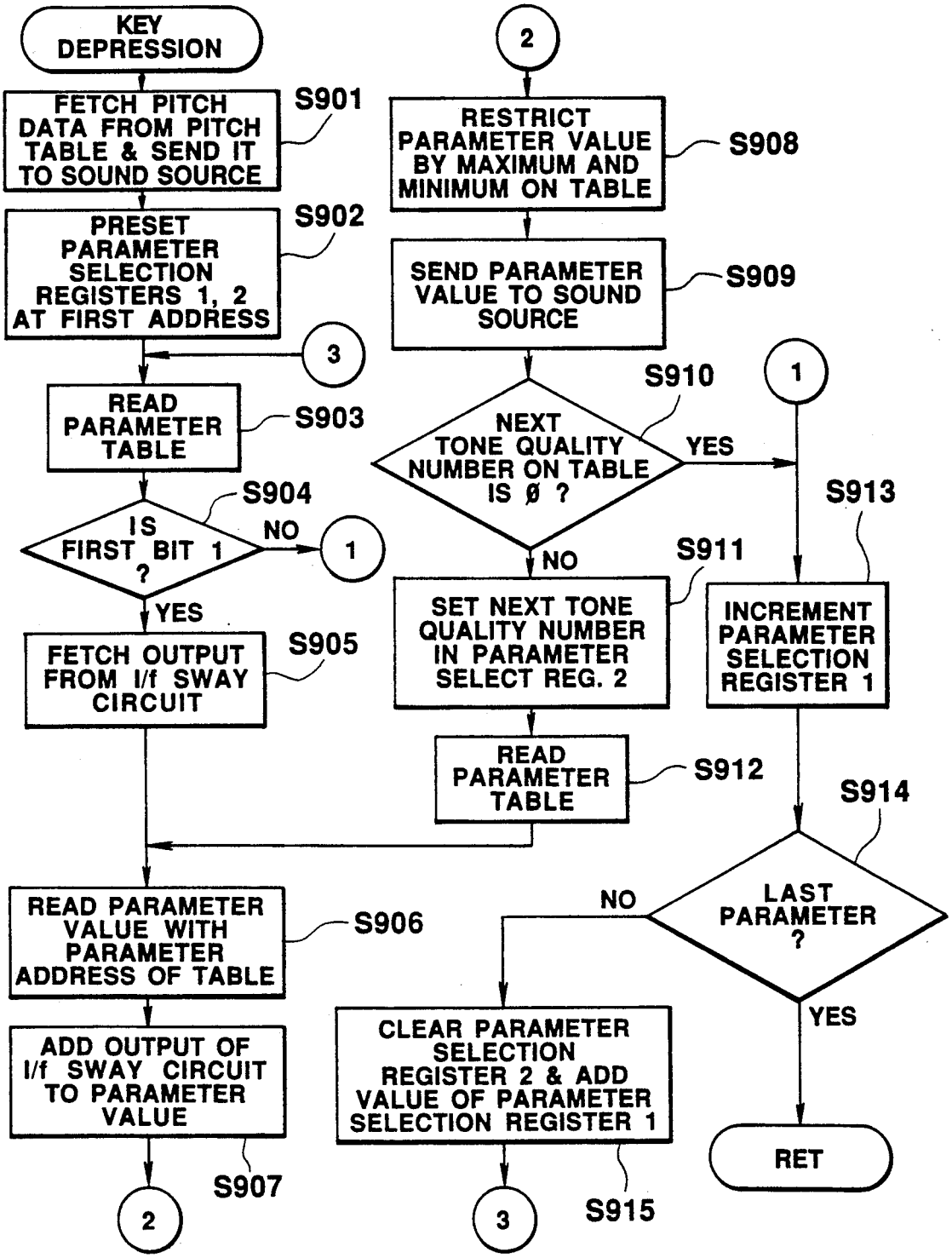
FIG. 9 is an operation flowchart indicative of a sound generation performed in a key-depressed state in the present apparatus.

In order to achieve the above basic operation, CPU 101 executes a program for key depression processing on the basis of the operation flowchart of FIG. 9 each time a key is depressed in keyboard 106. FIG. 10 shows a process for designating a tone parameter by parameter selective registers 1 and 2 on the basis of the operation flowchart described hereinafter.

First, when the player depresses key 106*c* of the keyboard unit 106, pitch data corresponding to the depressed key is fetched out of a pitch table (not shown) provided in RAM 103 and delivered to sound source 107 (step S901). Thus, the pitch of a musical sound is determined which should start to be generated by sound source 107.

Thereafter, the respective values of parameter selective registers 1,2 are preset at a first address 00H on the tone parameter table (step S902).

Then, the tone parameter table (FIG. 13) is accessed with tone number OOH designated by parameter selective register 2 (step S903) and it is checked whether the first bit of the tone number is 1 (step S904). In this case, since the first bit is 1, control passes to step S905 in which the 1/f sway output which is the output of 1/f sway circuit 105 is fetched.

Then, the tone parameter region on RAM 103 is accessed with tone number OOH designated by parameter selective register 2 to read out the parameter value. In this case, the parameter value of the tone parameter DC01_detune at address 00H set in parameter selective register 2 is read out (step S906).

The output from 1/f sway circuit 105 is added to the parameter value (step S907), and the resulting numerical value is restricted by the maximum and minimum values of the tone number OOH on the tone parameter table (step S908).

The resulting numerical value is delivered to sound source 107 (step S909). The tone number next to tone number OOH on the tone parameter table and designated by parameter selective register 2 is read out and it is determined whether the value is OOH or not (step S910).

In this case, since the tone number next to tone number 00H is 08H, the determination at step S910 is NO and control passes to step S911 where the next tone number 08H is newly set in parameter selective register 2 (step S911). The tone address of parameter selective register 1 remains 00H (see FIGS. 10(*a*)→(b)).

The tone parameter table is accessed with tone number 08H of parameter selective register 2 (see FIG. 14) and control returns to step S906. The tone parameter region of RAM 103 is accessed with tone number 08H designated by parameter selective register 2 to read out a parameter value in the same way as mentioned in the previous processing. In this case, the parameter value of tone parameter DC02_detune of tone number 08H is read out. The same 1/f sway output which is the same 1/f sway output as that with the previous tone number 00H is added to that parameter value (step S907), the resulting numerical value is restricted by the maximum and minimum values of tone number 08H of the tone parameter table (step S908), and the result is delivered to sound source 107 (step S909).

The tone number next to the current tone number 08H designated by parameter selective register 2 on the tone parameter table is 10H (see FIG. 14), so that the determination at step S910 becomes NO and the next tone number 10H is set newly in parameter selective register 2 at step S911 (see FIGS. 10(*b*)→(*c*)).

The tone parameter table is then accessed with tone number 10H of parameter selective register 2 (FIG. 15) and control then returns to step S906. The tone parameter region on RAM 103 is accessed with tone number 10H designated by parameter selective register 2 in a manner similar to the previous manner to read the parameter value. In this case, the parameter value of the tone parameter DC03_detune of tone number 10H is read out. The same 1/f sway output as that with tone number 00H is added to that parameter value (step S907), the resulting value is then restricted by the maximum and minimum values of tone number 08H on the tone parameter table (step S908), and the result is delivered to sound source 107 (step S909).

By the above processing, the same 1/f sway output is added to the tone parameters DC01_detune_DC03_detune of the same kind of the first-third parameter groups and the respective parameter values to which a similar "1/f sway" characteristic is added are transferred to sound source 107.

Subsequently, control passes to transmission of the next kind of tone parameters. First, since the tone number next to the current tone number 10H designated by parameter selective register 2 on the tone parameter table is 00H (see FIG. 15), the determination at step S910 is YES and control passes to step S913 where the tone address of tone parameter selective register 1 is incremented and its contents 00H change to 01H (see FIGS. 10(*c*)→(*d*)).

Thereafter, it is determined whether the tone address of tone parameter selective register 1 has exceeded 07H or the processing of the last parameter has been completed or not (step S914).

In this case, since the processing of the last parameter has not been terminated, step S915 is executed. In this case, the contents of parameter selective register 2 is cleared and the tone address value (at present, 01H) of parameter selective register 1 is added to the same register. As a result, the contents of register 2 become 01H (see FIG. 10(*d*)→(*e*)).

In this way, the tone address in each of the groups on the tone parameter table is changed from 00H to 01H, using parameter selective register 1.

The tone parameter table (FIG. 13) is accessed with tone number 01H designated by parameter selective register 2 (step S903) and it is checked whether the first bit of the tone number is 1 (step S904). In this case, since the first bit is 1, control passes to step S905, where a new 1/f sway output is fetched from 1/f sway circuit 105.

The same "1/f sway" characteristic is added to the respective tone parameters DC01_LFO_depth, DC02_LFO_depth and DC03_LFO_depth of the first, second and third parameter groups using the common 1/f sway output in the same manner as that with tone address 00H and the results are transferred to sound source 107.

As mentioned above, by designating of a tone color number by parameter selective register 2, replacing the number in register 2 with the next tone color number and repeating similar operations by the required number of times, the tone parameters of the same kind (at the same tone address) of the first, second and third parameter groups are successfully selected during which time the same "1/f sway" characteristic is added to the respective tone parameters of the first, second and third parameter groups using the common 1/f sway output and the results are transferred to sound source 107. Each time the processing up to the third parameter group is completed, parameter selective register 1 is incremented and its value is reset in register 2. Thus control shifts to the processing of tone color parameter of another kind (at another tone address) using a new 1/f sway output to add a "1/f sway" characteristic.

In this way, the values of parameter selective register 1 are sequentially incremented to 03H, 04H, 05H, . . . , 07H in this order. When the value of parameter selective register 1 becomes 08H after the processing for tone address 07H is completed (see FIG. 10(*f*)), the determination at step S914 becomes YES to terminate the processing performed when one key was depressed.

In response to the processing by CPU 101 when one key was depressed, mentioned above, sound source 107 generates musical sound waveform data on the basis of its received pitch data and various tone parameters. In this case, sound source 107 generates musical sound waveform data using 8 kinds of tone parameters of a parameter group, for example, varying depending on a tone range, as mentioned above. Since the same "1/f sway characteristic" is added to the tone parameters of the same kind even if the tone range may vary, an acoustically very comfortable musical sound is obtained in which the tones are harmonized among the respective tone range.

OPERATION OF CPU PERFORMED WHEN CHANGEOVER SWITCH IS SWITCHED ON

The operation of CPU 101 performed when changeover switch 106*b* (see FIG. 3) of keyboard unit 106 of FIG. 1 is switched on will be described hereinafter.

This changeover switch 106*b* is depressed to greatly and randomly change the tone parameters when the player is playing with keys 6*c*.

Figure 11:
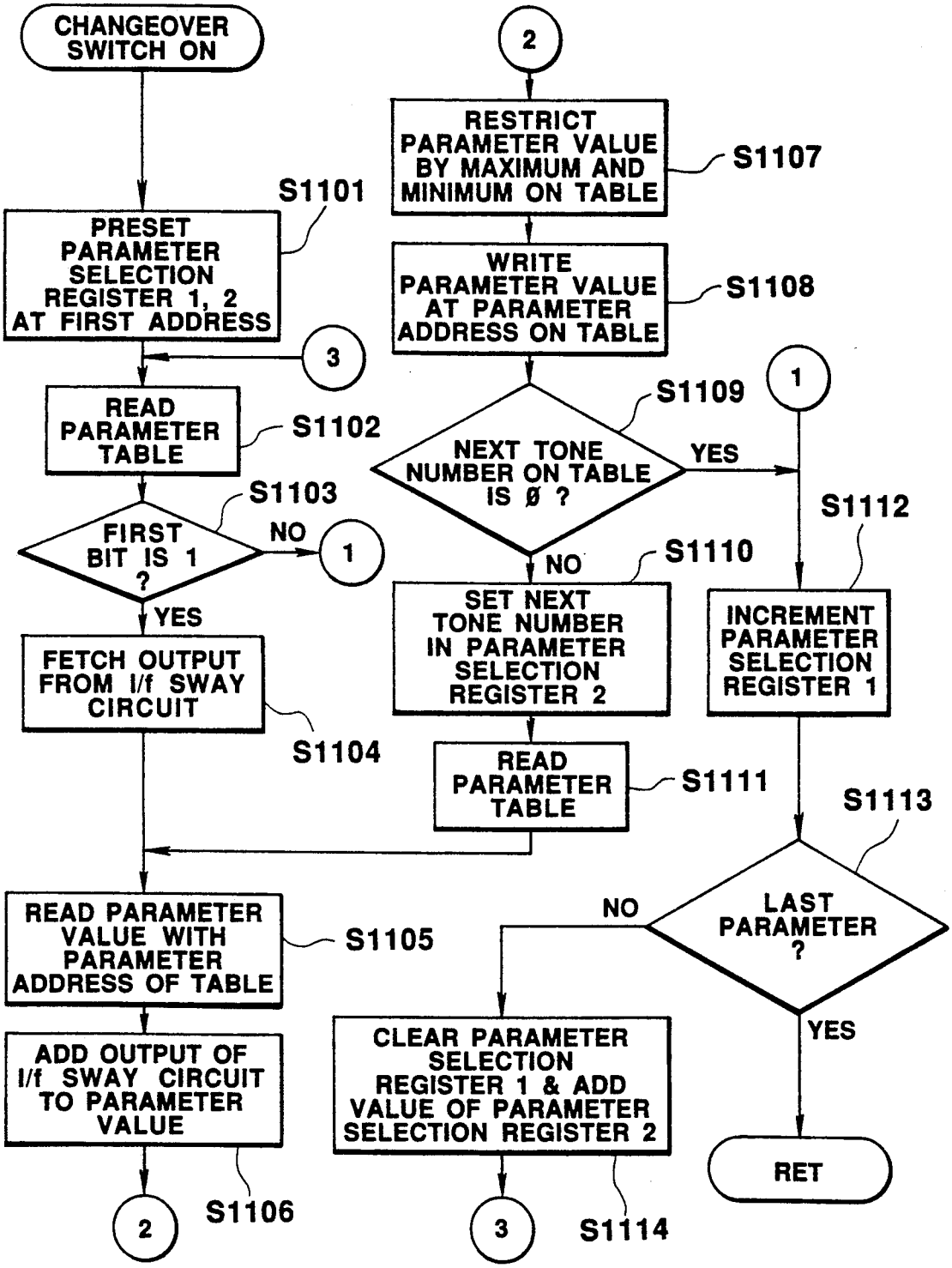

The operation of the CPU is shown by the operation flowchart of FIG. 11 which is substantially the same as the flowchart involving the operation of FIG. 9 performed when the key was depressed. Step S1101 corresponds to step S902 of FIG. 9 and the steps of FIGS. 11 and 19 are exactly the same except for step S1108, and further description of the processing except for step S1108 will omitted.

At step S1108 the parameter value restricted by the maximum and minimum values of the parameter table at the previous step S1107 is written at an address corresponding to the tone number of parameter selective register 2 on the tone parameter region of RAM 103.

When changeover switch 106*b* is depressed during playing as mentioned above, the output of 1/f sway circuit 105 is added to the parameter value existing so far to thereby change the value of the tone parameter set so far in accordance with the "1/f sway" characteristic. Also, in this case, the same "1/f sway characteristic" is added to the tone parameters of the same kind of different parameter groups.

In order to allow the tone parameters to greatly change on purpose, control is provided such that a large value is set in output amplitude register 407 of FIG. 4 to increase the amplitude of the 1/f sway output when the operation flowchart of FIG. 11 is executed.

Thereafter, when another key is depressed, the operation of FIG. 9 is performed on the basis of this new parameter value.

OPERATION OF CPU PERFORMED AT TIMER INTERRUPTION

Finally, the operation of CPU 101 to change the tone parameters at predetermined intervals of time by timer interruption during the playing operation will be described. The operation flowchart of FIG. 12 illustrates an interrupt program executed by CPU 101 when a timer (not shown) interrupts the execution at fixed intervals of time in the CPU 101 execution of the main program (not shown) during playing.

Also, in this case, the tone parameters are changed by addition of a "1/f sway" characteristic thereto and the results are delivered to sound source 107 to control the characteristic of a musical sound now under generation. It is to noted that in this case, relatively small changes in the tone parameters are made compared to those made when the changeover switch is depressed. Therefore, when the operation flowchart of FIG. 12 is executed, a substantially small value is set in output amplitude register 407 of FIG. 4 to thereby reduce the amplitude of the 1/f sway output.

Figure 12:
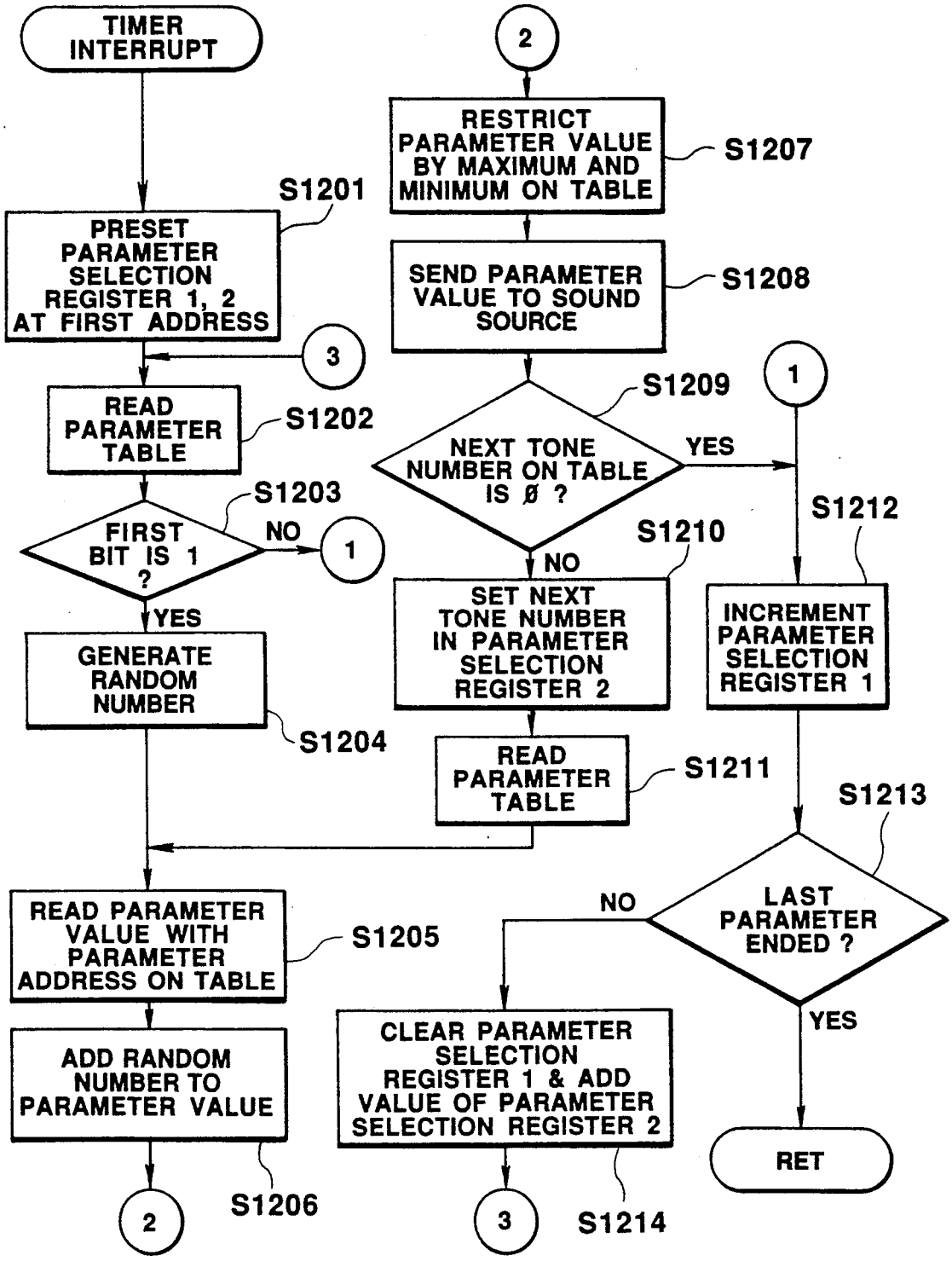
FIG. 12 is an operation flowchart indicative of sound generation of the present invention performed when a timer is interrupted.

The operation flowchart of FIG. 12 is exactly the same as the step S902 and subsequent steps of the flowchart of FIG. 9 executed when a key was depressed.

While in the present embodiment application of the tone parameter control apparatus according to the present invention to a keyed instrument has been described, it may be applied to musical instruments of other kinds.

While in the present embodiment the arrangement of an electronic musical instrument to which a tone parameter control apparatus according to the present invention is applied has been described, such parameter control apparatus may be applied, for example, to automatic playing apparatus which play melodies in accordance with the pitch data stored beforehand. Of course, a parameter control apparatus according to the present invention is applicable to any apparatus capable of generating musical sounds.

What is claimed is:

1. A tone parameter control apparatus comprising:

tone parameters storing means for storing a plurality of groups of tone parameters, said groups respectively including a plurality of tone parameters of the same kind which control a same characteristic of a musical sound to be generated;

fluctuation signal outputting means for outputting a fluctuation signal;

tone parameter readout means for sequentially reading out said tone parameters of the same kind from the respective groups of tone parameters stored in said tone parameter storing means; and parameter modulating means for modulating the respective tone parameters of the same kind read out by said tone parameter readout means with the same fluctuation signal generated at the same time by said fluctuation signal generating means and for re-storing the modulated tone parameters in said tone parameter storing means;

wherein said fluctuation signal generating means includes a 1/f fluctuation signal generating means for generating a 1/f fluctuation signal having a power spectrum substantially inversely proportional to the frequencies contained in said generated fluctuation signal.

2. An apparatus according to claim 1, further comprising:

group designating means for designating one of the plurality of groups of tone parameters stored in said tone parameter storing means; and tone parameter changing means for changing each of the tone parameters contained in the tone parameter group designated by said group designating means.

3. An apparatus according to claim 1, further comprising timer means for outputting a signal to operate said tone parameter readout means and said parameter modulating means at fixed intervals of time.

4. An apparatus according to claim 1, further comprising externally operable means for outputting a signal to operate said tone parameter readout means and said parameter modulating means.

5. An apparatus according to claim 1, wherein said 1/f fluctuation signal generating means comprises:

white noise data generating means for generating white noise data at fixed intervals of time;

filtering means for filtering the white noise data such that the white noise data has a power spectrum with a magnitude inversely proportional to the frequencies contained in said generated fluctuation signal; and interpolating means for interpolating data on the basis of filtered white noise data output sequentially from said filtering means.

6. An apparatus according to claim 1, wherein said tone parameter readout means sequentially reads out the tone parameters of the same kind, starting with tone parameters of the same kind contained in a predetermined tone parameter group, and designates and reads out tone parameters of another kind when all of the former tone parameters of the same kind have been read out.

7. An apparatus according to claim 6, wherein each tone parameter includes:

first data indicative of whether a tone parameter is a tone parameter to be read out first among the tone parameters of the same kind, data designating a tone parameter of said same kind of another tone parameter group to be read out next, end data indicative of whether a tone parameter is a tone parameter to be read out last among the tone parameters of said same kind, and wherein said tone parameter readout means designates the tone parameter to be read out first on the basis of the first data and reads out tone parameters sequentially on the basis of the designated data, and reads out a tone parameter of the next kind when reading out the last tone parameter of the kind handled so far has been detected on the basis of the end data.

8. An electronic musical instrument comprising:

pitch designating means for designating a pitch of a musical sound;

tone parameter storing means for storing a plurality of groups of tone parameters, said groups respectfully including a plurality of tone parameters of the same kind which control a same characteristic of a musical sound to be generated;

fluctuation signal outputting means for outputting a fluctuation signal;

tone parameter readout means for sequentially reading out said tone parameters of the same kind from the respective groups of tone parameters stored in said tone parameter storing means in response to an operation of said pitch designating means;

parameter modulating means for modulating the respective tone parameters of the same kind red out by said tone parameter readout means with the same fluctuation signal generated at the same time by said fluctuation signal generating means; and musical sound generating means for generating a musical sound on the basis of pitch data designated by said pitch designating means and tone parameters modulated by said parameter modulating means;

wherein said fluctuation signal generating means includes 1/f fluctuation signal generating means for generating a 1/f fluctuation signal having a power spectrum substantially inversely proportional to the frequencies contained in said generated fluctuation signal.

9. An electronic musical instrument according to claim 8, further comprising:

group designating means for designating one of the plurality of groups of tone parameters stored in said tone parameter storing means; and tone parameter changing means for changing each of the tone parameters contained in the tone parameter group designated by said group designating means.

10. An electronic musical instrument according to claim 8, wherein said 1/f fluctuation signal generating means comprises:

white noise data generating means for generating white noise data at fixed intervals of time;

filtering means for filtering the white noise data such that the white noise data has a power spectrum with a magnitude inversely proportional to the frequencies contained in said generated fluctuation signal; and interpolating means for interpolating data on the basis of filtered white noise data output sequentially from said filtering means.

11. An electronic musical instrument according to claim 8, wherein said tone parameter readout means sequentially reads out the tone parameters of the same kind, starting with tone parameters of the same kind contained in a predetermined tone parameter group, and designates and reads out tone parameters of another kind when all of the former tone parameters of the same kind have been read out.

12. An electronic musical instrument according to claim 11, wherein each tone parameter includes:

first data indicative of whether a tone parameter is a tone parameter to be read out first among the tone parameters of the same kind, data designating a tone parameter of said same kind of another tone parameter group to be read out next, end data indicative of whether a tone parameter is a tone parameter to be read out last among the tone parameters of said same kind, and wherein said tone parameter readout means designates the tone parameter to be read out first on the basis of the first data and reads out tone parameters sequentially on the basis of the designated data, and reads out a tone parameter of the next kind when reading out the last tone parameter of the kind handled has been detected on the basis of the end data.

13. A tone parameter control apparatus comprising:

tone parameter storing means for storing a plurality of groups of tone parameters, said groups respectively including a plurality of tone parameters of the same kind which control a same characteristic of a musical sound to be generated;

fluctuation signal outputting means for outputting a fluctuation signal; and parameter modulating means for modulating said tone parameters of a same kind from the respective groups of tone parameters stored in said tone parameter storing means with the same fluctuation signal generated at the same time by said fluctuation signal generating means;

wherein said fluctuation signal generating means includes a 1/f fluctuation signal generating means for generating a 1/f fluctuation signal having a power spectrum substantially inversely proportional to the frequencies contained in said generated fluctuation signal.

14. An apparatus according to claim 13, further comprising:

group designating means for designating one of the plurality of groups of tone parameters stored in said tone parameter storing means; and tone parameter changing means for changing each of the tone parameters contained in the tone parameter group designated by said group designating means.

15. An apparatus according to claim 13, further comprising timer means for outputting a signal to operate said parameter modulating means at fixed intervals of time.

16. An apparatus according to claim 13, further comprising externally operable means for outputting a signal to operate said parameter modulating means.

17. An apparatus according to claim 13, wherein said 1/f fluctuation signal generating means comprises:

white noise data generating means for generating white noise data at fixed intervals of time;

filtering means for filtering the white noise data such that the white noise data has a power spectrum with a magnitude inversely proportional to the frequencies contained in said generated fluctuation signal; and interpolating means for interpolating data on the basis of filtered white noise data output sequentially from said filtering means.

18. A tone parameter control apparatus comprising:

tone parameter storing means (102, 103) for storing a plurality of tone parameters which are different in kind and which are used for generation of a musical sound, said tone parameters which are different in kind controlling different characteristics of the musical sound being generated;

white noise data generating means (401) for generating white noise data at fixed intervals of time;

filtering means (402) for filtering the white noise data such that the white noise data has a power spectrum such that the magnitude of frequency components of the filtered white noise data are inversely proportional to a frequency relative to a given frequency of f;

tone parameter readout means (101) for reading out tone parameters stored in said tone parameter storing means (102, 103); and parameter modulating means (101) for modulating the tone parameters red out by said tone parameter readout (101) means with the filtered white noise data from said filtering means (402).

19. An apparatus according to claim 18, further comprising interpolating means (404) for interpolating data on the basis of filtered white noise data output sequentially from said filtering means (402).

20. An apparatus according to claim 18, further comprising externally operable means (106*b*) for outputting a signal to operate said parameter modulating means (101).

21. A 1/f fluctuation signal generating apparatus comprising:

white noise data generating means for generating white noise data at fixed intervals of time;

filtering means for filtering the white noise data such that the white noise data has a power spectrum such that the magnitude of frequency components of the filtered white noise data are inversely proportional to a frequency relative to a given frequency of f and for outputting the filtered white noise data as a 1/f fluctuation signal; and interpolating means for interpolating data on the basis of said filtered white noise data output sequentially from said filtering means.

* * * * *

UNITED STATES PATENT AND TRADEMARK OFFICE

CERTIFICATE OF CORRECTION

PATENT NO. : 5,298,676
DATED : March 29, 1994
INVENTOR(S) : SASAKI, Hiroyuki et al It is certified that error appears in the above-indentified patent and that said Letters Patent is hereby corrected as shown below:

Column 15, line 7 (claim 8), "red" should be --read--

Signed and Sealed this

Seventh Day of November, 1995

*Attest:*

*Attesting Officer*

Bruce Lehman

BRUCE LEHMAN

*Commissioner of Patents and Trademarks*